US006822572B2

(12) United States Patent
Lentine et al.

(10) Patent No.: US 6,822,572 B2
(45) Date of Patent: Nov. 23, 2004

(54) SKIER ALERT SYSTEM

(75) Inventors: Gregory E. Lentine, Orlando, FL (US); Louis F. Lentine, Jr., Windermere, FL (US)

(73) Assignee: Norcross Marine Products, Inc., Orlando, FL (US)

( * ) Notice: Subject to any disclaimer, the term of this patent is extended or adjusted under 35 U.S.C. 154(b) by 0 days.

(21) Appl. No.: 10/378,540

(22) Filed: Mar. 3, 2003

(65) Prior Publication Data

US 2003/0164777 A1 Sep. 4, 2003

Related U.S. Application Data

(63) Continuation-in-part of application No. 09/845,055, filed on Apr. 27, 2001, now Pat. No. 6,603,402.

(51) Int. Cl.[7] ..... G08B 23/00

(52) U.S. Cl. ..... 340/573.6; 340/539.1; 340/984

(58) Field of Search ..... 340/573.6, 665, 340/539.1, 984

(56) References Cited

U.S. PATENT DOCUMENTS

| | | | | |
|---|---|---|---|---|
| 3,983,483 A | * | 9/1976 | Pando | 455/90.2 |
| 4,483,683 A | | 11/1984 | Alley, Sr. | 441/69 |
| 4,624,141 A | | 11/1986 | Soleau | 73/865.8 |
| 4,689,611 A | | 8/1987 | Franklin | 340/539 |
| 4,934,972 A | | 6/1990 | Shumway et al. | 441/69 |
| 5,041,040 A | | 8/1991 | Jones et al. | 441/69 |
| 5,043,727 A | | 8/1991 | Ito | 340/984 |
| 5,167,550 A | | 12/1992 | Nielsen | 440/84 |
| 5,343,189 A | | 8/1994 | Alley, Sr. | 340/539 |
| 5,385,110 A | | 1/1995 | Bennett et al. | 114/285 |
| 5,408,221 A | | 4/1995 | Carsella, Sr. et al. | 340/604 |
| 5,694,337 A | | 12/1997 | Macken | 364/559 |
| 5,838,227 A | * | 11/1998 | Murray | 340/539.1 |
| 6,603,402 B2 | * | 8/2003 | Lentine et al. | 340/573.6 |

FOREIGN PATENT DOCUMENTS

| | | | |
|---|---|---|---|
| DE | 42 20 134 A1 | 12/1993 | G05G/1/02 |
| WO | WO 93/00258 | 1/1993 | B63H/21/22 |

* cited by examiner

*Primary Examiner*—Thomas J. Mullen, Jr.
(74) *Attorney, Agent, or Firm*—Allen, Dyer, Doppelt, Milbrath & Gilchrist, P.A.

(57) ABSTRACT

A water skier tow bar and float assembly includes a tow bar handle, control buttons on the tow bar handle and a float assembly connected to the tow bar handle. A wireless radio transmitter is mounted within the float assembly for generating wireless signals indicative of desired water skier conditions based on water skier actuation of the control buttons.

14 Claims, 7 Drawing Sheets

SKIER ALERT SYSTEM

RELATED APPLICATION

This application is a continuation-in-part application based upon prior filed utility application Ser. No. 09/845,055 filed Apr. 27, 2001, now U.S. Pat. No. 6,603,402.

FIELD OF THE INVENTION

This invention relates to water skier safety devices, and more particularly, this invention relates to wireless water skier alert systems.

BACKGROUND OF THE INVENTION

Water skiing is becoming a popular past time and recreational activity. It requires not only a boat operator driving a boat towing a water skier via a rope and tow bar handle secured thereto, but also an observer positioned in the boat as a passenger, who constantly monitors the water skier performance. The observer notes to the water skier whether the water skier indicates a desire for changed water skier conditions, such as speeding up, slowing down, or turning around, or has fallen and requires the boat to return and pull the water skier back up out of the water either into a skiing position, or draw the skier into the safety of the boat.

When an observer is not available, it is necessary to include a device to apprise immediately a boat operator if a skier has fallen or voluntarily released hold of the ski rope. This is necessary to ensure that the boat operator does not continue driving the boat a long distance from the location where the water skier has fallen, and thus, placing the water skier into a dangerous position where other boats could run over him or her. Some systems use a wire extending from a water skier tow bar handle to an alarm positioned within the boat indicating when a skier has fallen. This could be accomplished, such as when the tow bar handle hits the water and blocks a signal generated from a transmitter. Other systems, such as disclosed in U.S. Pat. No. 4,689,611, use a wireless transmitter for generating a signal that generates an alarm after the skier lets go of the tow bar handle. In these systems, a preselected frequency is no longer transmitted and an alarm is activated by closure of a switch.

Other systems use complicated tow bar handles, such as disclosed in U.S. Pat. No. 4,483,683, teaching a complicated handle assembly with on/off switches and manually actuated trigger switches. U.S. Pat. No. 5,408,221 discloses a downed water skier warning system using electronic water sensors for sensing when the rope-handle of the skier tow-rope lands in the water. These water and pressure sensors are in remote communication with audible and visual tow boat operator alarms and visual "skier down" warning indicators.

The copending '055 application overcomes these prior art problems such that the standard cylindrically configured and longitudinally extending tow bar handle is used with a skier alert system to generate not only an indication of a "skier down" signal, but also generate other signals that indicate a desired water skier condition, such as speeding up, slowing down, a directional turning around, or stop. The simple system provided for the boat operator to know when a skier down condition has occurred and when any change occurs in desired water skier conditions.

In the copending '055 application, a water skier alert system is used with a boat towing a water skier via a rope and tow bar handle secured thereto and allows a water skier to indicate to a boat operator desired water skier conditions. The system also can indicate a skier down condition. This water skier alert system includes a radio receiver that is adapted to be positioned on the boat towing the water skier for receiving wireless radio signals transmitted from the tow bar handle in response to a skier down condition or the water skier's actuation of actuator controls to indicate a desired water skier condition. A display is operative with the receiver and has indicia on the display that are actuated by the wireless transmitter signals and indicative of the skier down condition and each of the desired water skier conditions.

In that system, the water skier tow bar handle assembly comprises a cylindrically configured and longitudinally extending tow bar handle to which a tow rope is secured for towing a water skier and defining a surface having a grip over which the fingers and hands of the water skier can clasp. The tow bar handle defines a battery compartment, and in one non-limiting aspect of the present invention, has at least one open end defining the battery compartment for receiving at least one battery.

A pressure sensor is positioned at the grip portion and sensitive to hand and/or finger pressure exerted by a water skier. Control actuators are positioned along the grip and are water skier actuated to indicate a desired water skier condition. A wireless radio transmitter is positioned within the tow bar handle and operatively connected to a battery mounted within the battery compartment, the pressure sensor, and the control actuators for generating wireless signals indicative of a skier down condition when pressure is no longer exerted on the pressure sensor and desired water skier conditions after water skier actuation of the control actuators.

SUMMARY OF THE INVENTION

The present invention provides a more sturdy structure where the electronics that were previously incorporated in the tow bar handle as shown in FIGS. 1–6 are now positioned in a float assembly as shown in FIGS. 8 and 12. Thus, the tow bar handle can be formed even stronger to withstand the severe forces often accompanying aquatic sports, such as water skiing, in which a user grasps the tow bar handle.

In accordance with the present invention, a water skier tow bar and float assembly includes a tow bar handle having a grip over which the fingers and hands of a user clasp. Control actuators as control buttons are positioned along the grip and actuated by a user and indicative of a desired water skier condition. A float assembly is connected to the tow bar handle. A wireless radio transmitter is mounted within the float assembly and operatively connected to the control buttons for generating wireless signals of desired water skier conditions after water skier actuation of the control buttons.

In one aspect of the present invention, a battery compartment is contained within the float assembly and receives at least one battery for powering the wireless radio transmitter. The desired water skier conditions can comprise a speed up, a slow down, a turn and/or a stop position. An antenna can be operatively connected to the wireless radio transmitter. The antenna is carried by the float assembly, in one aspect of the present invention.

In another aspect of the present invention, each control button actuates the wireless transmitter and generates a wireless signal indicative of a desired water skier condition. The control buttons can be formed to respond to pressure exerted by a water skier. The control buttons can extend circumferentially around a portion of the tow bar handle. The control buttons each extend about 180 degrees around a portion of the tow bar handle and can be color coded to indicate desired water skier conditions.

In yet another aspect of the present invention, a water skier alert system is used with a boat towing a water skier via a rope and a tow bar handle and float assembly secured thereto. A radio receiver is adapted to be positioned on the boat towing the water skier for receiving wireless radio signals transmitted from a tow bar handle and float assembly in response to water skier actuation of a desired water skier condition. A display is operative with the receiver for displaying a desired water skier condition and is actuated by the wireless transmitter signals and indicative of desired water skier conditions. The desired water skier conditions can be a speed up, a slow down, a turn and/or stop condition. The display preferably comprises an alphanumeric display. The alarms can sound for a predetermined period of time indicative of the desired water skier condition.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
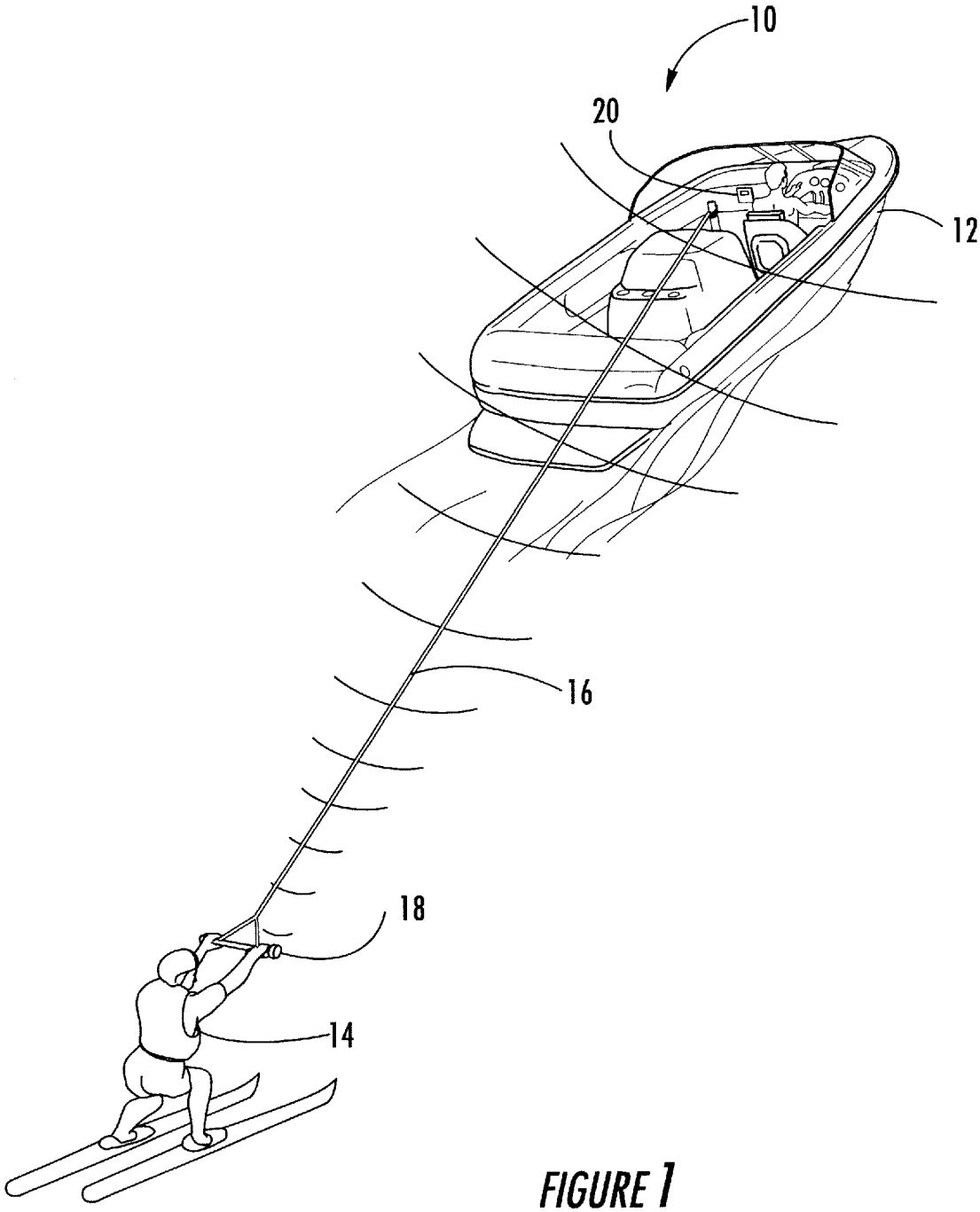
FIG. 1 illustrates a schematic, environmental view of the use of the water skier alert system in a first embodiment and showing various components of the system, including the water skier tow bar handle assembly and radio receiver and display unit positioned within a boat.

FIG. 1 illustrates an overall environmental view of a water skier alert system 10 of a first embodiment and showing a boat 12 towing a water skier 14 via a rope 16 and tow bar handle 18 secured thereto. For purposes of this description, the term "water skier" describes any user of the skier alert system, such as a user being pulled on a raft or other means. The boat 12 includes only a boat operator (shown in phantom lines) and no observer to observe the water skier for a "skier down" condition, such as when the water skier has fallen, or an indication from the water skier of a desire to change water skier conditions, such as turning around, speeding up, stopping or slowing down. The water skier alert system 10 includes a wireless radio receiver and display unit 20 that is positioned on the boat towing the water skier and receives wireless radio signals transmitted from the tow bar handle 18 in response to a skier down condition or water skier actuation of a desired water skier condition.

Figure 5:
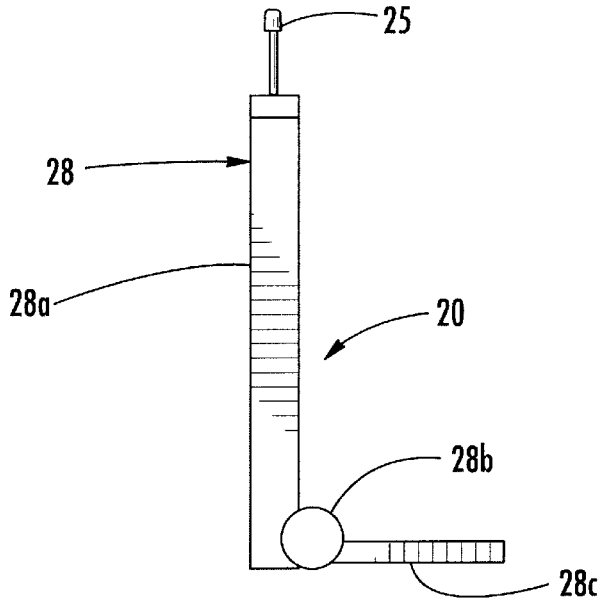
FIG. 5 is a side elevation view of an adjustable built-in stand that can be used for holding the radio receiver and display unit.

The radio receiver and display unit 20 includes a visual display 22 that is operative with a wireless radio receiver 24 that receives signals via antenna 25. The display 22 includes indicia 26 that are actuated via a processor 27 (FIG. 6) by wireless transmitter signals from the tow bar handle and indicative of a skier down condition and each of the desired water skier conditions. The radio receiver and display unit 20 is preferably built in one non-limiting example as an integral unit that is placed on an adjustable, built-in stand 28 that can be tilted in any desired angular direction to enhance the viewing angle by the boat operator (FIG. 5). The built-in stand 28 can include a back support 28*a*, pivot mount 28*b* and horizontal support 28*c*, which can be attached to a support on the boat.

Figure 2:
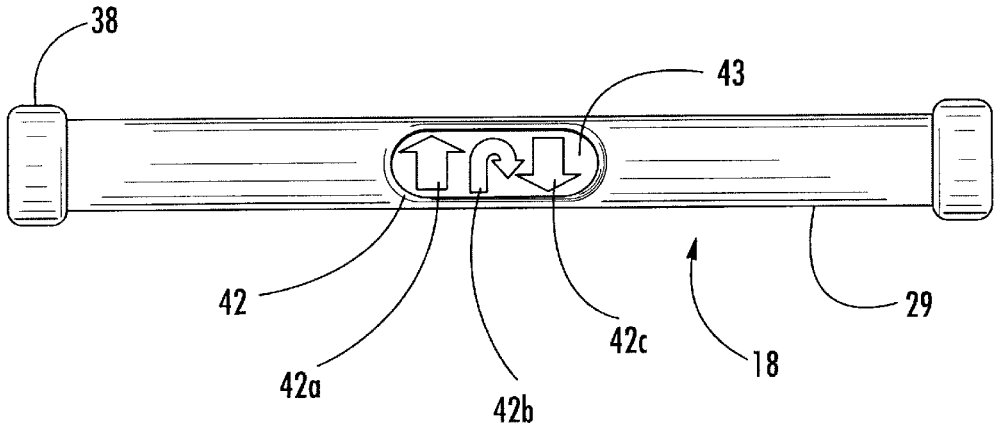
FIG. 2 is a more detailed view of the water skier tow bar handle assembly and showing the end cap and control actuators.
Figure 3:
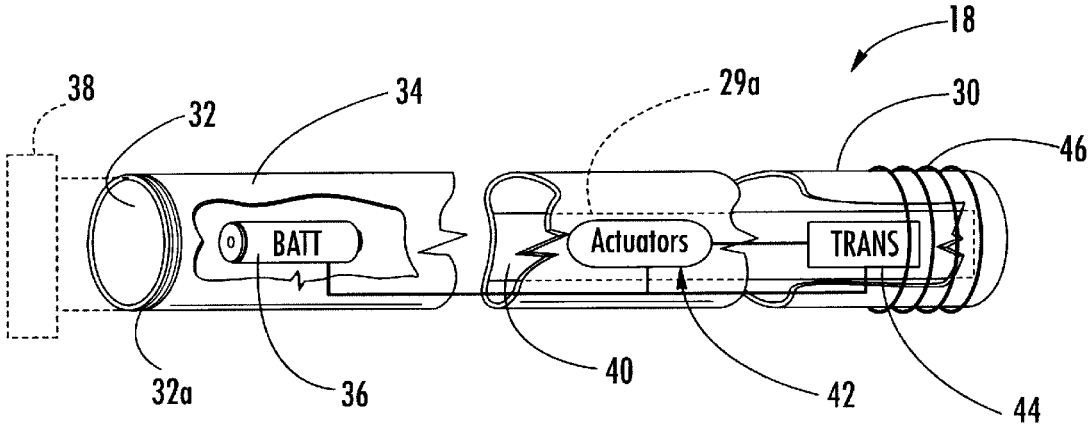
FIG. 3 is a fragmentary drawing of the water skier tow bar handle assembly, showing various components including the pressure sensor, battery compartment and battery, control actuators, wireless radio transmitter, and antenna.

The water skier tow bar handle 18 is formed as an assembly of component parts as a cylindrically configured and longitudinally extending member to which the tow rope 16 is secured for towing the water skier. As shown in FIGS. 2 and 3, the tow bar handle assembly defines a surface having a grip portion 29 over which the fingers and hands of a water skier clasp. This grip portion 29 can be formed from rubber or other similar grip material that enhances the water skier grip on the handle. This grip material is formed, in one aspect of the present invention, over a cylindrically configured and longitudinally extending body member 30 (FIG. 3), which contains the various components of the tow bar handle assembly.

As illustrated, the tow bar handle 18 has at least one open end 32 and defines a battery compartment 34 within the interior of the body member 30 for receiving at least one battery 36. A battery compartment cover is formed in this illustrated aspect of the present invention as an end cap 38 and is removably mounted on the open end 32 of the tow bar handle. It holds the at least one battery within the battery compartment. Naturally, the end cap is water sealed when positioned over the open end and can include threads for sealingly engaging threads 32*a* positioned on the open end of the handle. It is possible that the battery compartment could be formed with a side access panel.

The grip portion 29 includes a front grip portion 29*a* having a pressure sensor 40 positioned at that location and sensitive to hand and/or finger pressure exerted by the water skier. The pressure sensor 40 can be formed as a longitudinally extending pressure strip, as illustrated in FIG. 3, which extends along the front grip portion 29*a*. This strip can be embedded in the rubber or other grip material or on the outer surface. The pressure sensor 40 could also be positioned under the grip material forming the grip portion and against the body member 30.

Control actuators 42 are positioned along the rear grip portion 29*b* facing the water skier and indicate through user actuation a desired water skier condition, such as a water skier desire to speed up, slow down, or turn around. In one aspect of the present invention, these control actuators are pressure actuated control buttons that respond to pressure exerted by the water skier. As illustrated, three control buttons 42*a*, 42*b* and 42*c* are illustrated that are user actuated for indicating speed up, turn around, or slow down. In one aspect of the invention, each button is positioned about ⅛ inch below the surface of the handle in an open slotted area 43 formed within the grip material and the cylindrically configured body member 30. Each button, however, could be formed flush or some other depth instead of ⅛ inch. In one aspect of the invention, the buttons 42*a*, 42*b*, 42*c* are configured as an up arrow to indicate a speed up for the desired water skier condition, a down arrow to indicate a slow down for the desired water skier condition, and a 180° arrow turn to indicate a turn around condition.

As illustrated, a wireless radio transmitter 44 is positioned and sealed in a waterproof manner within the tow bar handle and is operatively connected to the battery 36 mounted within the battery compartment 34, the pressure sensor 40, and the control actuators 42 for generating wireless signals to the radio receiver and display unit 20 indicative of a skier down condition when pressure is no longer exerted on the pressure sensor 40 and desired water skier conditions after skier actuation of the control actuators 42.

An antenna 46 is operatively connected to the wireless radio transmitter 44. It can be mounted on or inside the tow bar handle 18, or at other locations suggested by those skilled in the art. In one aspect of the invention, it is mounted as a coil wound over the tow bar handle, as illustrated. Although any number of wireless radio transmitters can be used in the present invention, a simple spread spectrum wireless transmitter that is operative within unlicensed bands established by the Federal Communications Commission or an FM or other similar wireless radio transmitter could be used. The electronics associated with the wireless radio transmitter include basic electronic circuitry known to those skilled in the art for generating wireless signals indicative of a skier down condition or desired water skier conditions, such as a wireless signal indicative of speed up, a wireless signal indicative of slow down, or a wireless signal indicative of a turn around condition. These wireless signals could form many types of modulation, such as a simple on/off pulse modulation as in Morse code, or the more complicated modulation and coding arrangements for indicating the desired water skier conditions and skier down condition.

The control actuators 42*a*, 42*b* and 42*c* can be color coded for indicating the desired conditions and to facilitate any water skier's selection of the control actuators based on a color difference. For example, the speed up control actuator 42*a* could be green, the slow down control actuator 42*b* could be yellow, and the turn around control actuator 42*c* could be blue.

The display 22 of the radio receiver and display unit 20 acts as a gauge to indicate the skier down condition or indicate a change in the desired water skier conditions after a water skier actuates the control actuators 42 or the water skier lets go of the tow bar handle, and thus, the pressure sensor, such as when the skier falls. In one aspect of the present invention, the display 22 is formed as a liquid crystal display (LCD) and includes indicia 26, such as four icons, each indicative of what the water skier has actuated, such as stop sign icon 50*a* that is indicative of the skier down condition, and icons 50*b*, 50*c* and 50*d* that are configured similar to the indicia of the control actuator buttons, as illustrated, which indicated the speed up, slow down, or turn around desired skier conditions. It should be understood, however, that any number of different icon designs or other indicia configurations can be used for both the indicia on the display and the control actuators on the tow bar handle.

In one preferred aspect of the present invention as illustrated, simple designs, such as the illustrated stop sign and arrows, are used. The LCD can be a color LCD display and the indicia 26, e.g., the icons, can be color coded in the same color as the control actuators. The stop sign icon can be the color red and can light when the skier is down and has dropped the tow bar handle. Additionally, the display could be an LED, instead of an LCD, depending on cost.

Each icon or other indicia 26 used on the display can blink five times to aid in capturing the boat operator's attention and allowing the boat operator to observe that a condition has changed. The display could be programmed such that the icons blink fewer than five times, or greater than five times, as desired, by individual action and choice.

In another aspect of the present invention, an alarm 54 is operatively connected to the wireless radio receiver and display unit 20 (FIG. 4) and can sound for three seconds for each action, indicating a change in water skier conditions, such as speed up, slow down, or turn around. The alarm 54 can sound for a longer, five second period, indicative of a skier down condition, which is more important and demands immediate attention by the boat operator. Each condition change indicated on the display could have its own distinctive tone or series of tones when the alarm is generated. Thus, it is possible that the boat operator would not have to look down at the display to determine what condition has changed.

Figure 6:
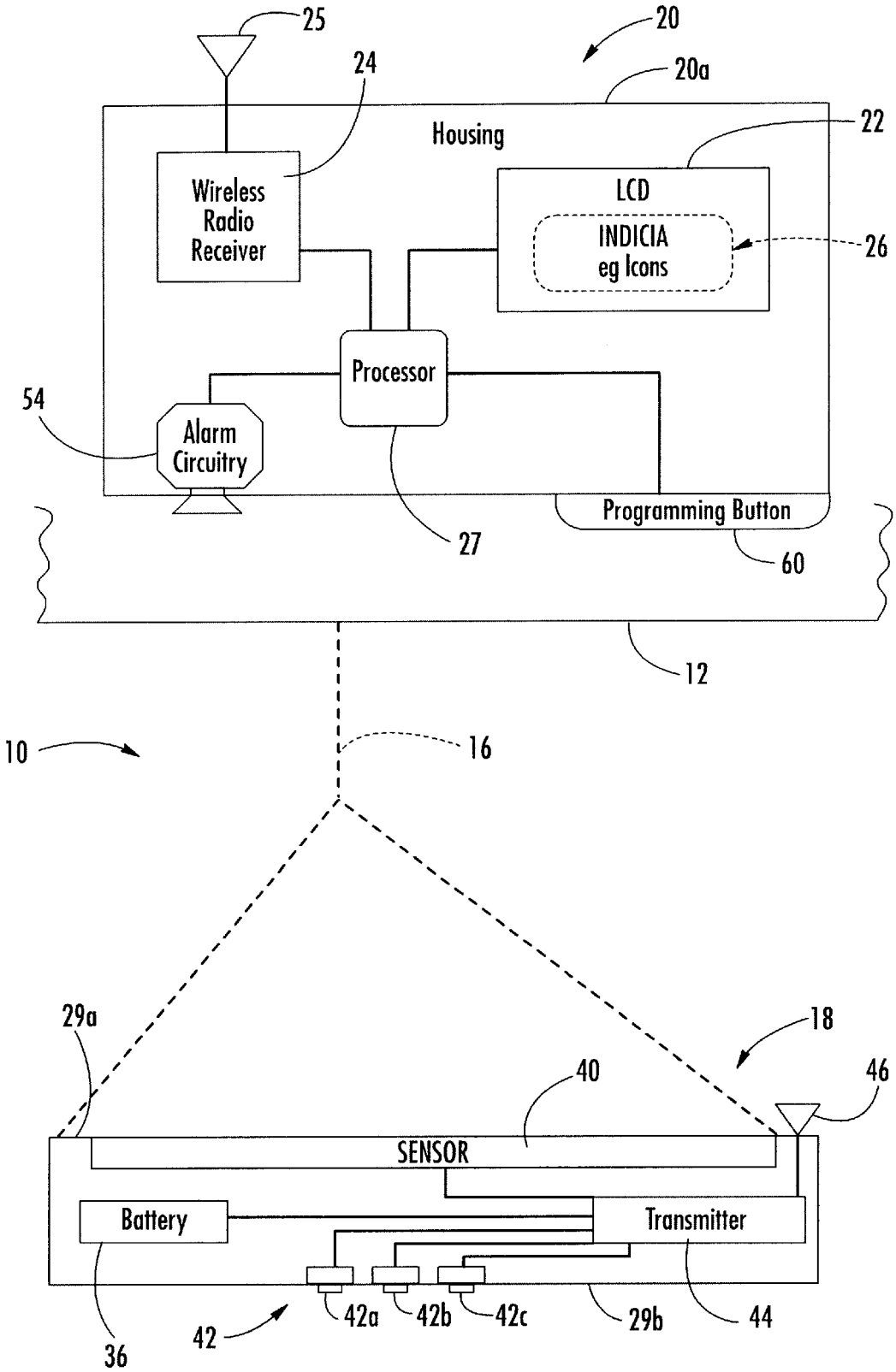
FIG. 6 is a block diagram showing one example of the type of circuits that can be used with the water skier alert system.

FIG. 6 illustrates a schematic block diagram of the skier alert system 10 showing the radio receiver and display unit 20 and the tow bar handle 18. As illustrated, the tow bar handle 18 includes the previously discussed components, including the battery 36, wireless transmitter 44, pressure sensor 40, antenna 46 and control actuators 42 as three buttons that can be selected by the water skier for actuating the transmitter to transmit a wireless signal.

Figure 4:
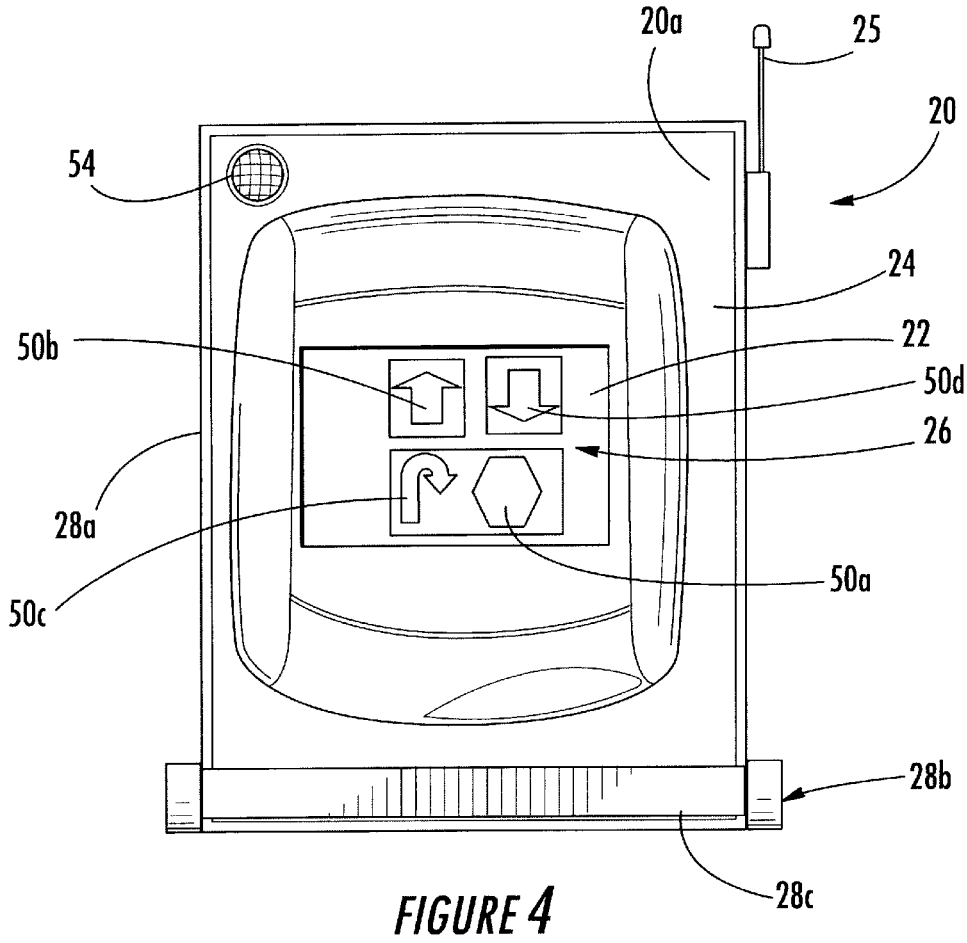
FIG. 4 is an elevation view of the display and receiver.

The radio receiver and display unit 20 includes a housing 20*a*, as also illustrated in FIG. 4, supporting the LCD display 22 with the various indicia 26, e.g., icons. The radio receiver 24 is connected to the antenna 25 and receives signals from the tow bar handle 18. A microprocessor 27 or other controller is connected to the wireless radio receiver 24 and the LCD 22 and generates the appropriate signals for displaying the proper icons on the display. A series of programming buttons or a simple one touch programming button 60, as illustrated, is operatively connected to the microprocessor 27 and allows a user to program the display and alarm system for actuating different types of icons and different audible alarms. These components can be selected and configured in a circuit design as known to those skilled in the art.

Figure 7:
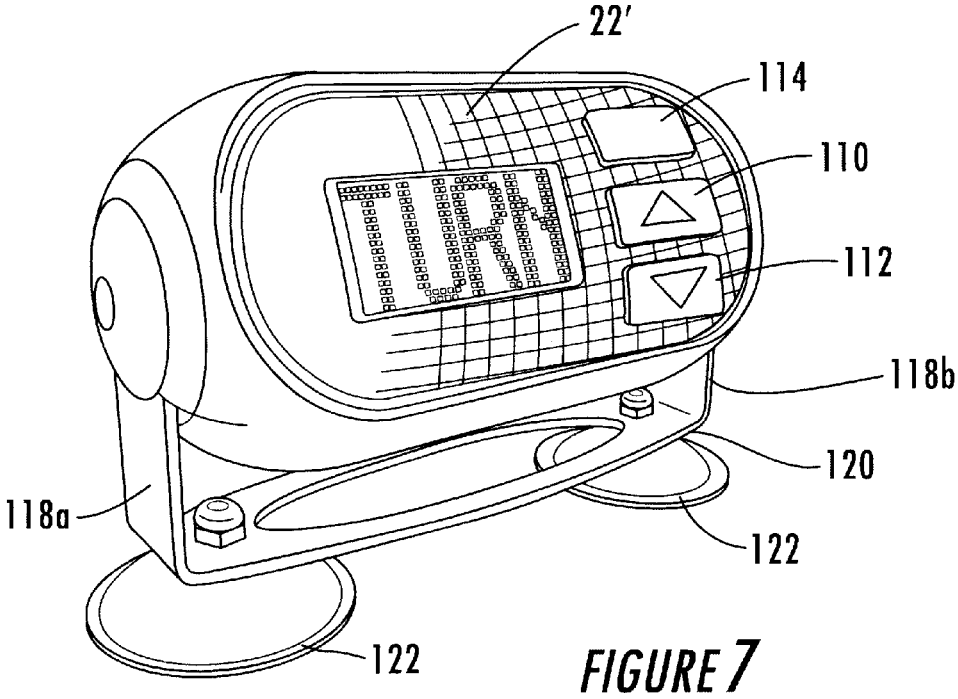
FIG. 7 is an isometric view of the display and receiver in accordance with a second embodiment and showing the alphanumeric display.
Figure 8:
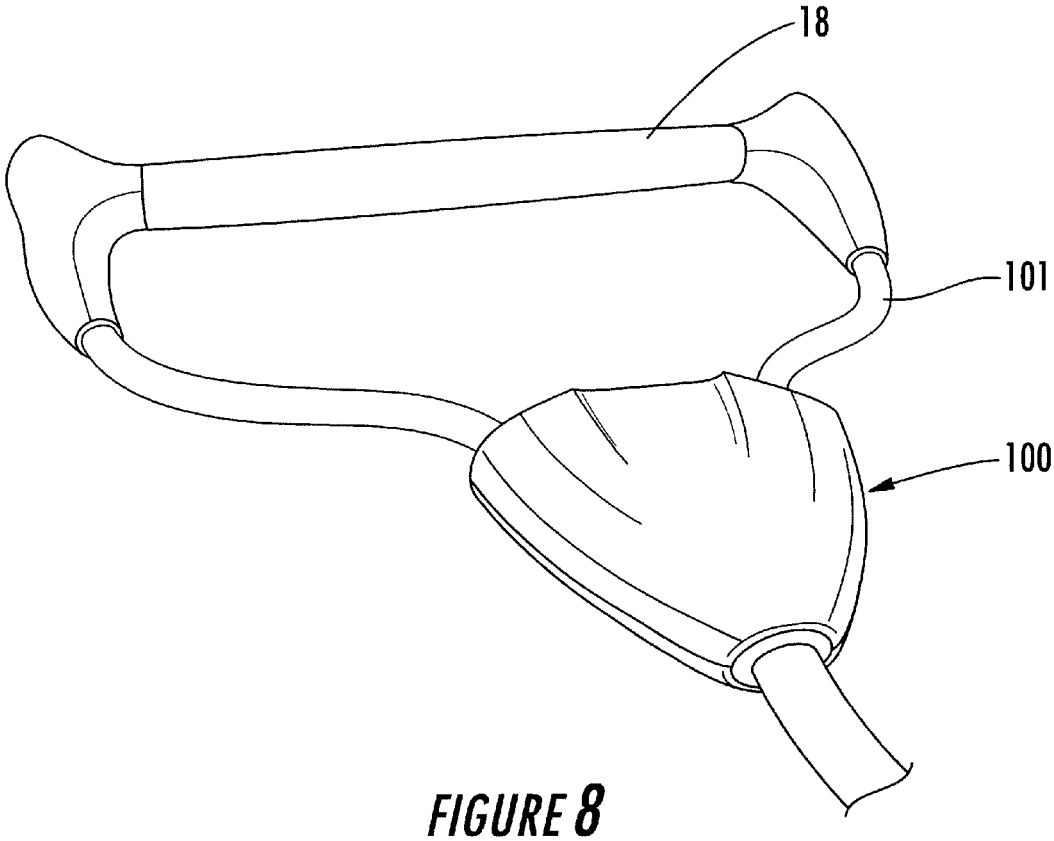
FIG. 8 is an isometric view of the tow bar handle and the floating assembly, which contains many of the electronics previously incorporated in the tow bar handle in the first embodiment of FIGS. 1–6.
Figure 9:
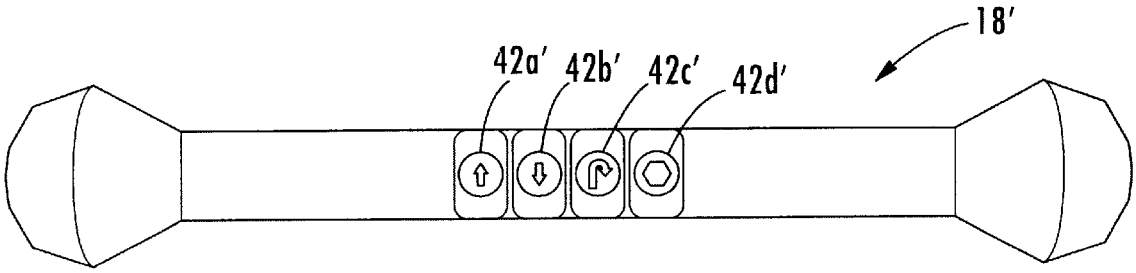
FIG. 9 is an elevation view of the tow bar handle and showing control actuators that extend about 180 degrees around the handle.
Figure 10:
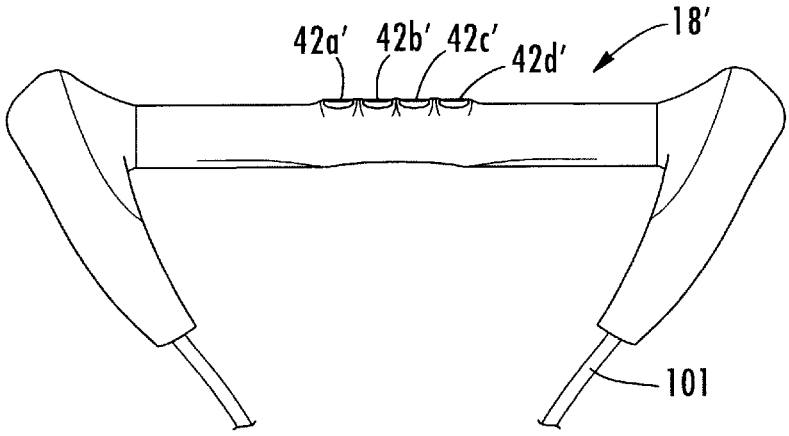
FIG. 10 is a top plan view of the tow bar handle and showing a portion of the control actuators.
Figure 11:
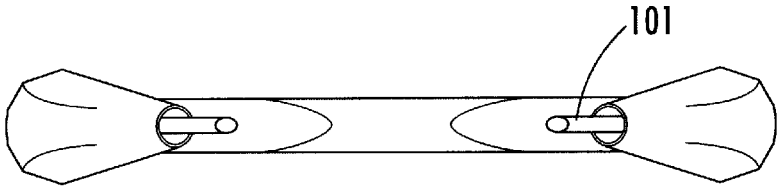
FIG. 11 is a rear elevation view of the tow bar handle.
Figure 12:
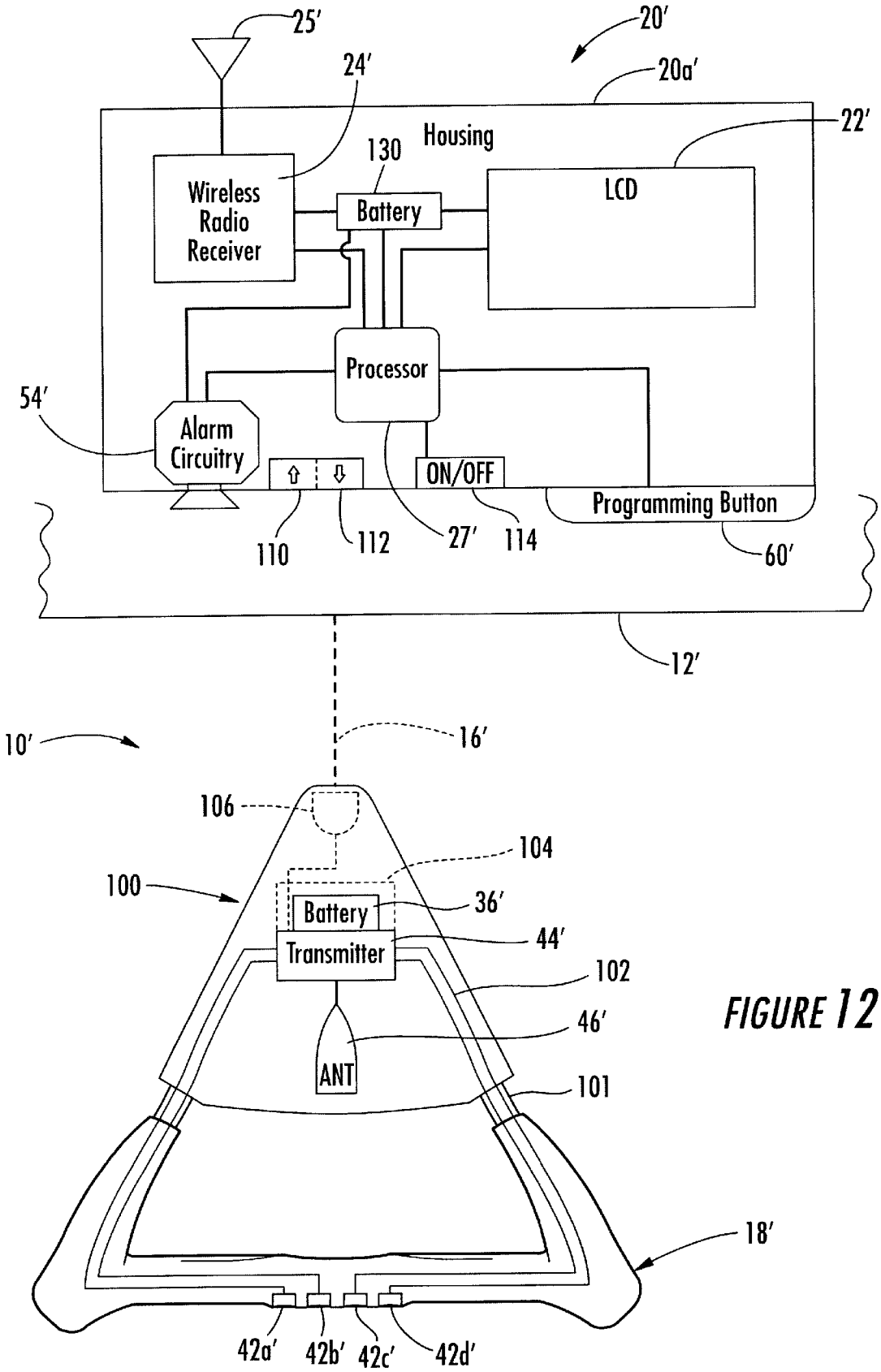
FIG. 12 is a block diagram showing one example of the type of circuits that can be used for the water skier alert system in accordance with the second embodiment and showing the float assembly that incorporates the electronic components, including the wireless transmitter.

FIGS. 7–12 illustrate a second embodiment of the present invention where the electronics previously incorporated in the tow bar handle 18, as shown in FIGS. 1–6, are positioned in a float assembly 100 as shown in FIGS. 8 and 12. For purposes of clarity, in the description of this second embodiment, similar functional elements as set forth in FIGS. 1–6 are described with reference numerals using prime notation. The float assembly 100 is connected to the tow bar handle 18' by tow bar ropes 101. The tow bar-handle 18' can have a grip as in the previous embodiment. As shown in FIGS. 9 and 12, the control actuators are shown as four control actuators formed as buttons 42*a*', 42*b*', 42*c*' and 42*d*' that are formed similar to control actuators explained relative to the embodiment shown in FIGS. 1–6. In this present embodiment, however, the buttons extend about 180 degrees around the tow bar handle 18' to make it easier for the water skier or other aquatic user of the tow bar handle to see the buttons even when the user holds the tow bar handle near the waist, as sometimes a user will do in aquatic sports. The control actuators as four buttons 42*a*', 42*b*', 42*c*' and 42*d*' are formed as separate buttons corresponding to the indicated up, down, turn and stop directions. Instead of a stop button, there could be two turn buttons, one for the left turn and the other for the right turn. The control buttons could be color coded or have no indicia.

The four buttons 42*a*', 42*b*', 42*c*' and 42*d*' are operatively connected to wiring 102 that extends through the tow bar handle 18' to the float assembly 100, which includes the transmitter 44', battery 36' and antenna 46'. The battery 36' could be inserted within the float assembly 100 via a removable access cover 104. The sensor is not included in this particular embodiment, but could be as indicated by the dashed lines 106. The sensor is particularly not advantageous if a user is on a craft being pulled and grabs the tow bar handle 18, which often would contact the water.

As shown in FIGS. 7 and 12, the radio receiver and display unit 20' could be formed as an attractive display having a face with an alphanumeric display 22' that would display the various instructions from the water skier operating the control actuators, such as turn, up (faster), down (slower) and stop. Other control buttons, such as up and down volume control buttons 110,112, could be operative with the alarm circuitry 54' either directly with that circuitry or through the processor 27' to control the volume of the alarm. The up and down buttons could also be operative with a programming button or other functional circuitry to program various functions.

The housing 20' shown in FIG. 7 is substantially cylindrically configured and includes a flat face on which the alphanumeric display 22' is formed, together with the up and down control buttons 110,112 and an on/off button 114. The housing could be mounted on a stand 116 as shown in FIG. 7, which includes two upstanding leg supports 118*a*, 118*b* mounted to a base 120. Suction cups 122 can be used to secure the base and the housing 20' on a dash. The circuit could include a battery 130 (FIG. 12) for turning the radio receiver and display unit on and off by powering the wireless radio receiver 24', alarm circuitry 54', processor 27' and display 22'.

Other common components as shown in FIG. 12 that are similar to the embodiment shown in FIG. 6 include the wireless radio receiver 24', antenna 25', processor 27' and the programming button 60' that could be used in some instances. The alphanumeric display 22' uses alphanumeric characters instead of icons. It should be understood, however, that icons can also be used.

It is evident that the present invention permits a boat operator to determine changed skier conditions in a simple and efficient manner, while also allowing a water skier to signal the boat operator of any desire for speeding up, turning around, slowing down, stopping or other desired skier conditions in a simple and efficient manner. The float assembly 100 allows the tow bar handle to be normal in configuration and strong. The display and receiver unit can be easily mounted on a dash with the suction cups or other means, while allowing audible alarms that can be programmed by the user.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A water skier tow bar and float assembly comprising:

a tow bar handle having a grip over which the fingers and hands of a user clasp;

control actuators positioned along the grip and actuated by a user and indicative of a desired water skier condition;

a float assembly connected to said tow bar handle; and a wireless radio transmitter mounted within the float assembly and operatively connected to the control actuators for generating wireless signals of desired water skier conditions based on user actuation of the control actuators.

2. A water skier tow bar assembly according to claim 1, and further comprising a battery compartment within the float assembly for receiving at least one battery for powering the wireless radio transmitter.

3. A water skier tow bar and float assembly according to claim 1, wherein said desired water skier conditions comprise a speed up, a slow down, a turn and/or a stop condition.

4. A water skier tow bar and float assembly according to claim 1, and further comprising an antenna operatively connected to said wireless radio transmitter.

5. A water skier tow bar and float assembly according to claim 1, wherein said antenna is carried by said float assembly.

6. A water skier tow bar and float assembly according to claim 1, wherein said control actuators comprise a plurality of control buttons that each actuate said wireless transmitter for generating a wireless signal indicative of a desired water skier condition.

7. A water skier tow bar and float assembly according to claim 6, wherein said control buttons comprise pressure actuated control buttons that respond to pressure exerted by a water skier.

8. A water skier tow bar and float assembly according to claim 6, wherein said control buttons each extend circumferentially around a portion of the tow bar handle.

9. A water skier tow bar and float assembly according to claim 6, wherein said control buttons extend about 180 degrees around a portion of the tow bar handle.

10. A water skier tow bar and float assembly according to claim 6, wherein said control buttons are color coded.

11. A water skier alert system used with a boat towing a water skier via a rope and a tow bar handle and float assembly secured thereto comprising:

a radio receiver that is adapted to be positioned on the boat towing the water skier for receiving wireless radio signals transmitted from a tow bar handle and float assembly, wherein the signals are indicative of a desired water skier condition; and a display operative with the receiver for displaying a desired water skier condition as actuated by the wireless radio signals and indicative of desired water skier conditions.

12. A water skier alert system according to claim 11, wherein said desired water skier condition comprises a speed up, a slow down, a turn and/or stop condition.

13. A water skier alert system according to claim 11, wherein said display comprises an alphanumeric display.

14. A water skier alert system according to claim 11, and further comprising an alarm that sounds for a predetermined period of time indicative of a desired water skier condition.

* * * * *